United States Patent [19]

Yasuda et al.

[11] 4,206,460

[45] Jun. 3, 1980

[54] EL DISPLAY DRIVE CONTROLLED BY AN ELECTRON BEAM

[75] Inventors: Shuhei Yasuda; Toshihiro Ohba, both of Tenri; Chuji Suzuki, Nara, all of Japan

[73] Assignee: Sharp Kabushiki Kaisha, Osaka, Japan

[21] Appl. No.: 884,474

[22] Filed: Mar. 8, 1978

[30] Foreign Application Priority Data

| | | | |
|---|---|---|---|
| Mar. 10, 1977 | [JP] | Japan | 52-27777 |
| Mar. 10, 1977 | [JP] | Japan | 52-27778 |
| Jun. 21, 1977 | [JP] | Japan | 52-75282 |

[51] Int. Cl.[2] ..... H05B 33/00

[52] U.S. Cl. ..... 340/781; 315/169.3; 340/794

[58] Field of Search ..... 315/12, 169 TV, 169.3; 340/165, 324 R, 324 M, 781, 794

[56] References Cited

U.S. PATENT DOCUMENTS

| | | | |
|---|---|---|---|
| 2,905,849 | 9/1959 | Kazan | 315/169 TV |
| 3,087,086 | 4/1963 | Turner | 315/12 X |
| 3,152,222 | 10/1964 | Loebner | 315/169 TV |
| 3,579,015 | 5/1971 | Gregory | 315/169 TV |
| 3,659,149 | 4/1972 | Fleming | 315/169.3 |
| 4,070,663 | 1/1978 | Kanatani et al. | 340/784 |

*Primary Examiner*—David L. Trafton

*Attorney, Agent, or Firm*—Birch, Stewart, Kolasch & Birch

[57] ABSTRACT

An EL display panel comprises an electroluminescent element made of, for example, a ZnS:Mn layer sandwiched between a pair of dielectric layers. A front electrode is formed on one of the dielectric layers, and a rear electrode is formed on the other dielectric layer in order to apply a voltage signal across the electroluminescent element. An electron beam is applied to the electroluminescent element through the rear electrode to provide the electroluminescence at the position to which the electron beam is applied. A desired pattern is displayed on the EL display panel by properly controlling the application of the electron beam.

8 Claims, 10 Drawing Figures

EL DISPLAY DRIVE CONTROLLED BY AN ELECTRON BEAM

BACKGROUND OF THE INVENTION

The present invention relates to an EL display panel and, more particularly, to a drive system of an EL display panel.

The present invention relates, more specifically, to a writing method for writing desired information into an EL display panel which shows memory characteristics.

An electroluminescent element of a three-layer construction is well known in the art, which comprises a semiconductor electroluminescent thin film made of, for example, a ZnS layer doped with Mn (ZnS:Mn) or a ZnSe layer doped with Mn (ZnSe:Mn) sandwiched between a pair of dielectric thin films made of $Y_2O_3$, $Si_3N_4$, $TiO_2$, $Al_2O_3$, or $SiO_2$. The above-mentioned electroluminescent element exhibits electroluminescence of a high brightness upon receiving an A.C. voltage signal of several kilohertz. And, the above-mentioned electroluminescent element of a three-layer construction shows the long life operation.

By properly controlling the amount of Mn doped within the electroluminescent layer and the fabrication conditions, the above constructed electroluminescent element exhibits the hysteresis properties within light intensity versus applied voltage characteristics as disclosed by Y. KANATANI et al, U.S. Pat. No. 3,967,112, "PHOTO-IMAGE MEMORY PANEL AND ACTIVATING METHOD THEREOF" on June 29, 1976.

A typical drive method for the above-mentioned electroluminescent element of the three-layer construction was disclosed in the above-mentioned U.S. Pat. No. 3,967,112, wherein the photo-image is applied onto the electroluminescent element, and the thus written image is held by applying a sustaining alternating signal to the electroluminescent element.

Generally, the electroluminescence of the electroluminescent element can be controlled through the use of a voltage signal applied across the electroluminescent layer, or light or heat applied to the electroluminescent layer. When the electroluminescent element has hysteresis loop characteristics, the combined control of the sustaining voltage and the write-in signal comprising a write-in voltage signal or a write-in optical beam signal will considerably increase the application of the electroluminescent element in various fields.

OBJECTS AND SUMMARY OF THE INVENTION

Accordingly, an object of the present invention is to provide a novel drive system for an electroluminescent element. Another object of the present invention is to provide a drive system for an electroluminescent display panel, which utilizes an electron beam.

Still another object of the present invention is to combine a sustaining voltage signal with an electron beam write-in signal in an EL display panel which shows hysteresis characteristics.

Yet another object of the present invention is to enhance the display quality of an electroluminescent display panel.

A further object of the present invention is to simplify a drive system of an EL display panel.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, an EL display panel is provided which comprises an electroluminescent layer made of, for example, a ZnS:Mn thin film sandwiched between a front dielectric layer made of $Y_2O_3$, $Si_3N_4$, $Al_2O_3$, $SiO_2$ or $TiO_2$ and a rear dielectric layer made of $Y_2O_3$, $Si_3N_4$ or $TiO_2$. A front transparent electrode made of $SnO_2$ or $In_2O_3$ is formed on the front dielectric layer, and a rear electrode made of, for example, aluminum is formed on the rear dielectric layer. The thus formed EL element of the three-layer construction is supported by a glass substrate in such a manner that the front transparent electrode confronts the glass substrate.

An alternating voltage signal is applied to the EL element through the use of the front and rear electrodes. In addition to the application of the voltage signal, an electron beam is applied to the EL element through the rear aluminum electrode to provide the electroluminescence at the position to which the electron beam is applied. A desired pattern is displayed on the EL display panel by properly controlling the application of the electron beam in such a manner as is well known in the art of the cathode-ray tube.

In a preferred form, the EL element is so constructed as to show the memory characteristics. In this case, the information written in the EL element by the electron beam is maintained by applying a sustaining voltage signal across the two electrodes formed on the EL element.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Referring now in detail to the drawings, and to facilitate a more complete understanding of the present invention, basic characteristics of an electroluminescent element of a three-layer construction, and a conventional drive method of the electroluminescent element will be first described with reference to FIGS. 1 and 2.

Figure 1:
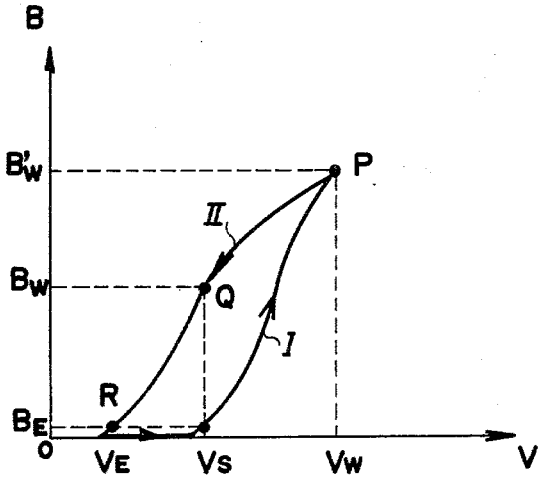
FIG. 1 is a graph showing hysteresis properties included within electroluminescent brightness versus applied voltage characteristics of an electroluminescent element of a three-layer construction.

FIG. 1 is a graph showing hysteresis properties included within electroluminescent brightness versus applied voltage characteristics of an electroluminescent element of a three-layer construction. The electroluminescent brightness [B] is shown along the ordinate axis, and the peak value [V] of the applied alternating voltage pulse signal is shown along the abscissa axis. The electroluminescent element includes an electroluminescent layer made of a ZnS:Mn thin film.

It will be clear from FIG. 1 that the hysteresis loop is observed in the brightness increasing curve I, where the applied voltage is increased, and the brightness decreasing curve II, where the applied voltage is decreased.

Figure 2:
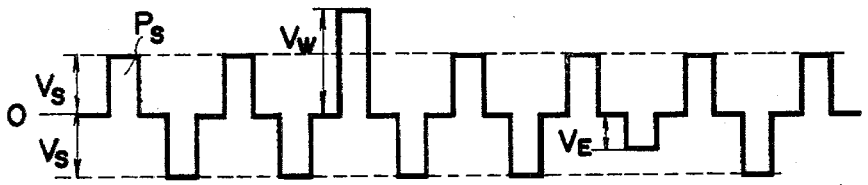
FIG. 2 is a time chart of an alternating voltage signal of the conventional drive system for the electroluminescent element having the hysteresis characteristics shown in FIG. 1.

FIG. 2 shows a typical drive signal used in the conventional drive system of the electroluminescent element. When preferably controlled light, heat energy or a voltage signal is applied to the EL element under the condition where a predetermined electric field is applied across the EL element, electrons captured in the trap level in the ZnS:Mn layer are released from the trap level and travel in the ZnS:Mn layer. The thus produced conduction electrons function to excite the Mn luminescent center to provide electroluminescence. The brightness of the electroluminescence is proportional to the intensity of the applied light, heat energy or voltage signa, since the generation of the conduction electrons are proportional to the applied light, heat energy or voltage signal.

Preferably, a sustaining voltage $V_s$ is selected at a level where the difference is sufficiently large between the brightness $B_E$ in the brightness increasing curve I and the brightness $B_W$ in the brightness decreasing curve II. An alternating pulse train $P_s$ having an amplitude of the sustaining voltage $V_s$ is applied to the EL element to maintain the brightness of the electroluminescence at the level $B_E$. When a write-in pulse voltage $V_W$ is momentarily applied to the EL element, the brightness is momentarily increased to the level $B'_W$ (point P) and, thereafter, the brightness is held stationary at the level $B_W$ (point Q) by the following alternating pulse train $P_s$.

When an erase pulse voltage $V_E$ is momentarily applied to the EL element held at the point Q, the brightness is suddenly reduced and maintained at the level $B_E$ by the following alternating pulse train $P_s$. It will be apparently noted that the levels $B_W$ and $B_E$ can be selected at desired values by properly controlling the levels of the write-in pulse voltage $V_W$ and the erase pulse voltage $V_E$.

Figure 3:
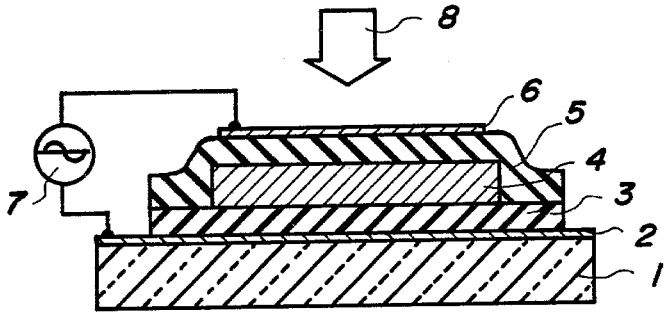
FIG. 3 is a sectional view of an electroluminescent element employed in an embodiment of the present invention.

FIG. 3 shows an electroluminescent element of a three-layer construction employed in an embodiment of the present invention.

A transparent electrode 2 made of $In_2O_3$ or $SnO_2$ is formed on a glass substrate 1. A first insulation thin film 3 made of $Y_2O_3$, $Si_3N_4$, $Al_2O_3$, $SiO_2$ or $TiO_2$ is formed on the transparent electrode 2, and a thin-film ZnS layer 4 doped with Mn is formed thereon. Thereafter, a second insulation thin film 5 made of $Y_2O_3$, $Si_3N_4$ or $TiO_2$ is formed on the thin-film ZnS:Mn layer 4 to sandwich the thin-film ZnS:Mn layer 4 between the first and second insulation thin films 3 and 5, and a rear metal electrode 6 made of, for example, aluminum is formed thereon. These layers 2 through 6 are formed through the use of, for example, an evaporation method or a sputtering method. The transparent electrode 2 and the rear metal electrode 6 are formed in such a manner to cover the entire surface of the thin-film ZnS:Mn layer 4 and are connected to receive a voltage signal 7 through lead electrodes. An electron beam 8 is applied to the EL element through the rear metal electrode 6 under the condition where the EL element is disposed in a vacuum container. The number of electrons reaching the ZnS:Mn layer 4, and a voltage generated in the ZnS:Mn layer 4 will be calculated as follows as a function of an acceleration voltage of the electron beam.

The number of primary electrons which reach a position of which the depth from the surface of the aluminum rear electrode 6 is d can be calculated as follows:

$$n(\rho d) = n_o(1 - 4\times 10^4 \times Z^{\frac{1}{2}} \cdot \rho \cdot d/E_0^{1.7}) \ldots \quad (1)$$

where:

$n(\rho d)$ is the number of the primary electrons which reach the position of which the depth is d;

$n_o$ is the number of the primary electrons which reach the surface of the rear electrode 6;

$\rho$ is the density (gr/cm$^3$) of the thin film;

$E_o$ is the acceleration voltage (KV) of the electron beam; and

Z is the atomic number of the material for the thin film, and in case where the thin film is made of compound, $$Z = \tilde{Z} = \sum_{i=n} Ci \cdot Zi \text{ (where } Ci \text{ is wt\%)}$$

In the foregoing calculation, the scattering effects are omitted from the consideration, since the sample is a thin film and only the minimum value is desired to be obtained.

A voltage E at the position of which the depth is d in the thin-film layer can be calculated as follows:

$$\rho d = \frac{7.68 \times 10^{18}}{N_o \sum_{i=n} (C_1 \cdot Z_i/M_i)} [E_o^2 F(E_o Z) - E^2 F(E/Z)] \quad (2)$$

where:

$$F(E/Z) = \frac{1}{y}\left(1 + \frac{1}{y} + \frac{2!}{y^2} + \ldots\ldots\right) \quad (3)$$

$$y = 2 \cdot \mathrm{Ln}\,(174E/Z) \ldots \quad (4)$$

$N_o$ is the Avogadro's number, namely, $6.022 \times 10^{23}$ $mol^{-1}$; and Mi is the atomic weight.

The following is an example, where the rear electrode 6 and the second insulation thin film 5 are made of aluminum and $Y_2O_3$ of the following characteristics, respectively.

Figure 4:
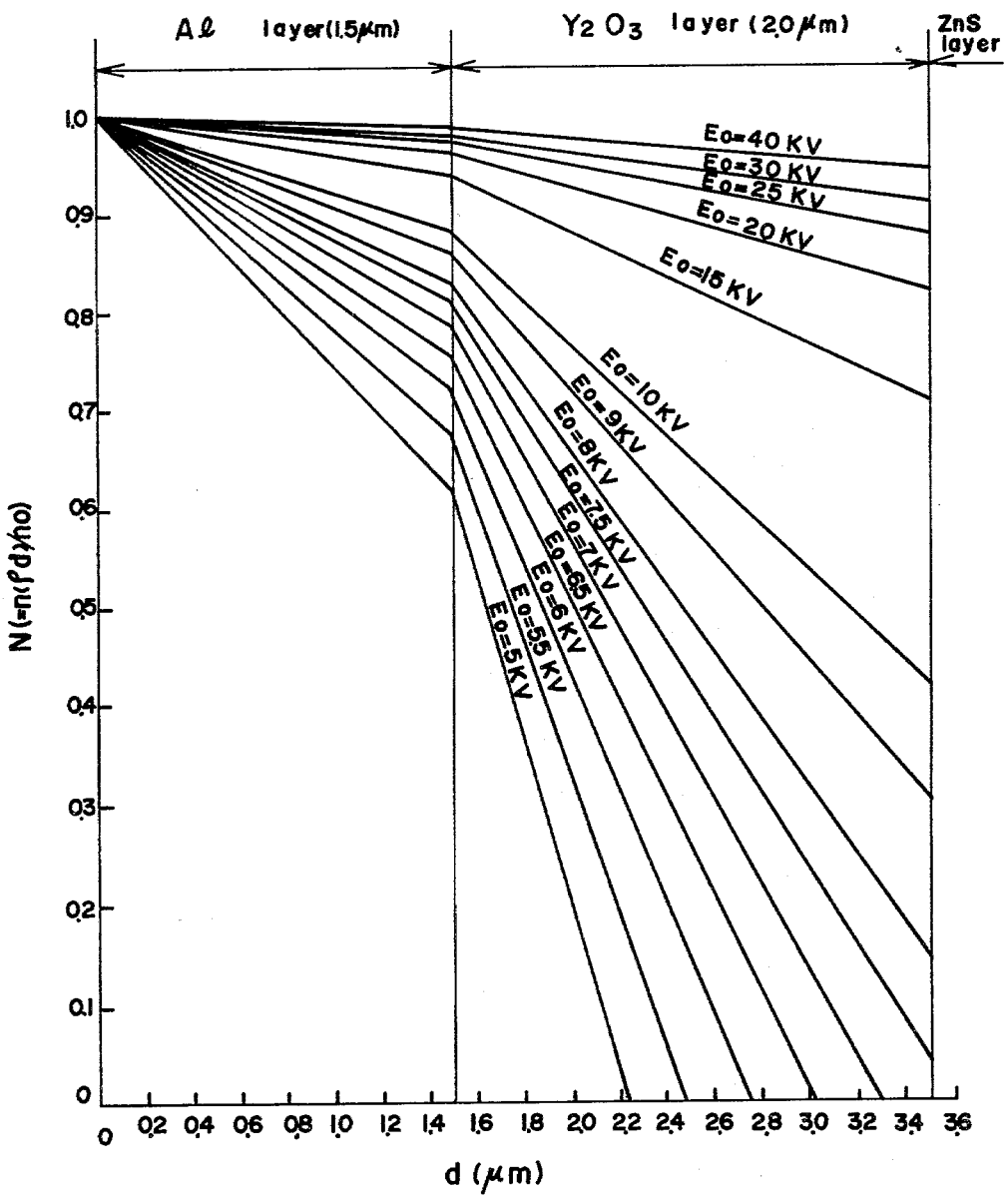
FIG. 4 is a graph showing relationships between the number of reached primary electrons and depth from a rear electrode when an electron beam is applied to the electroluminescent element of FIG. 3 through the rear electrode.
Figure 5:
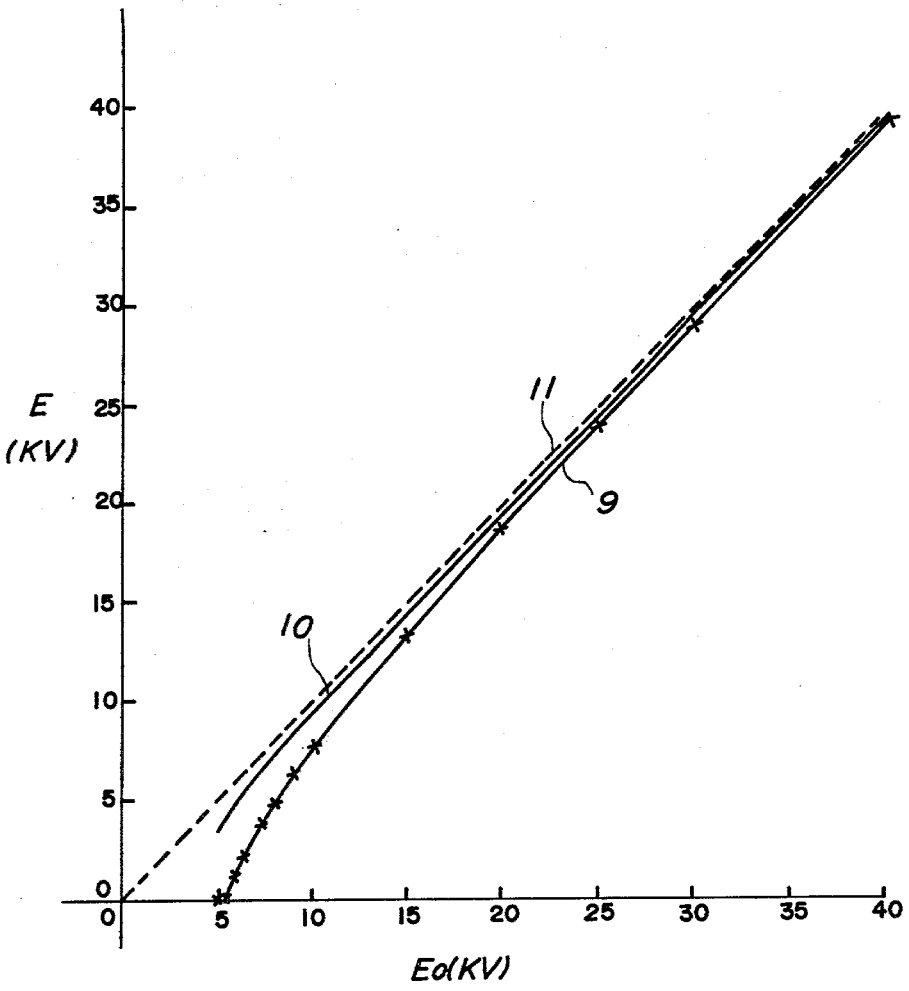
FIG. 5 is a graph showing relationships between a voltage generated in the electroluminescent element and an electron beam acceleration voltage when an electron beam is applied to the electroluminescent element of FIG. 3 through the rear electrode.

Al rear electrode: 1500 Å thickness $Z=13$ $M=26.98$ $\rho=2.69$ gr/cm$^3$ $Y_2O_3$ thin film: 2000 Å thickness $\rho \approx 5$ gr/cm$^3$ $Y{:}Z=39$ $M=88.91$ $O{:}Z=8$ $M=16$ FIGS. 4 and 5 show the calculated number of primary electrons and the voltage generated in the second insulation layer 5 and the ZnS:Mn layer 4, respectively, when the acceleration voltage $E_o$ is varied.

In FIG. 4, the axis of abscissas is graduated by the depth d ($\mu$m) from the surface of the aluminum rear electrode 6, and the axis of ordinates is graduated by the number of the primary electrons with the form of the number of the primary electrons reaching the surface of the aluminum rear electrode 6. In FIG. 5, the axis of abscissas is graduated by the acceleration voltage $E_o$(KV) of the electron beam, and the axis of ordinates is graduated by the generated voltage E(KV) due to the application of the electron beam. In FIG. 5, 9 represents the voltage generated on the surface of the ZnS layer 4, 10 represents the voltage generated on the surface of the $Y_2O_3$ thin film 5, and 11 represents the acceleration voltage.

In the case where the acceleration voltage $E_o$ is less than 7 KV, substantially no primary electrons reach the ZnS:Mn layer 4. Moreover, since the energy band of ZnS:Mn is about 20 eV, the ZnS:Mn layer 4 is sufficiently excited when the acceleration voltage $E_o$ is above 8 KV.

It will be clear from the foregoing description that desired information can be written in the EL element by applying the electron beam to the EL element. This is caused by the internal polarizations generated in the ZnS:Mn layer. The written information or the electroluminescence is maintained by the sustaining pulse train $P_s$ shown in FIG. 2.

More specifically, the EL panel can display a desired pattern when the electron beam of which the intensity is modulated in accordance with display information is applied to the EL panel in a scanning fashion under the condition where the sustaining pulse is applied to the EL panel. When it is desired to erase the written information, the erase pulse voltage $V_E$ shown in FIG. 2 is applied to the EL panel. Alternatively, the desired information can be written in the EL element by applying the electron beam to the EL element without applying the sustaining voltage to the EL element, that is, under the condition where the electrodes formed on both sides of the EL element are connected to each other.

Figure 6:
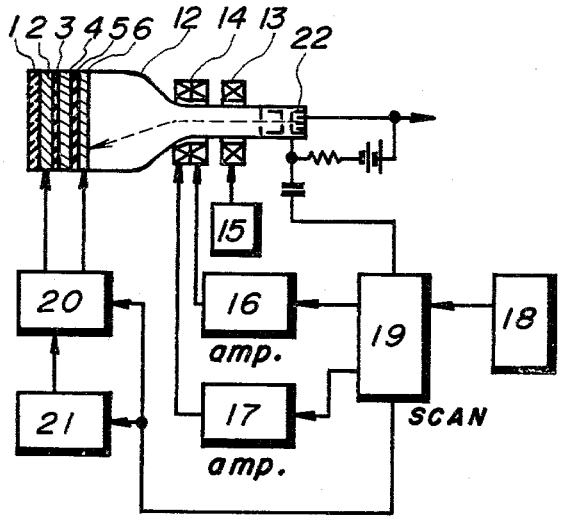
FIG. 6 is a block diagram of an embodiment of a drive system of the present invention.

FIG. 6 shows an embodiment of a drive system of the present invention.

The EL display panel of the same construction as shown in FIG. 3 is disposed at a display surface of a cathode-ray tube 12. That is, the glass substrate 1 of the EL element defines the front surface of the cathode-ray tube 12. A focus control electro-magnetic coil 13 and a deflection (X-Y directions) coil 14 are disposed as is well known in the art. The focus control electro-magnetic coil 13 is connected to receive a control signal derived from an electron beam focus control signal generator 15, and the deflection coil 14 is connected to receive control signals derived from an X-direction deflection amplifier 16 and a Y-direction deflection amplifier 17. The amplifiers 16 and 17 are connected to receive signals derived from a scanning signal generator 19, respectively, which is connected to receive a video signal derived from a modulator 18.

The front transparent electrode 2 and the rear metal electrode 6 of the EL display panel are connected to receive the sustaining pulse and the erase signal derived from the sustaining pulse signal generator 20 and the erase signal generator 21, respectively. The sustaining pulse signal generator 20 and the erase signal generator 21 are connected to receive a synchronization signal derived from the scanning signal generator 19. An electron beam generator 22 is disposed at the end of the cathode-ray tube 12. The electron beam generator 22 is connected to receive a brightness control signal derived from the scanning signal generator 19.

In synchronization with the synchronization signal derived from the scanning signal generator 19, the sustaining pulse signal is applied from the sustaining pulse signal generator 20 to the EL panel. The level of the sustaining pulse signal is selected to that the EL element exhibits the electroluminescence of the brightness $B_E$ shown in FIG. 1. At this moment, a desired pattern signal is developed from the modulator 18 and the electron beam is generated from the electron beam generator 22. The electron beam generated from the electron beam generator 22 is focused by the focus control electro-magnetic coil 13 and is deflected by the deflection coil 14 in accordance with the pattern signal and, then, applied to the EL element. The scanning signal generator 19 also functions to control the strength of the electron beam, whereby the brightness of the electroluminescence is controlled. A position where the electron beam is impinged exhibits the light of the brightness $B'_W$ (see FIG. 1) and, then, the position is maintained at the brightness $B_W$ (see FIG. 1) by the sustaining pulse.

Figure 7:
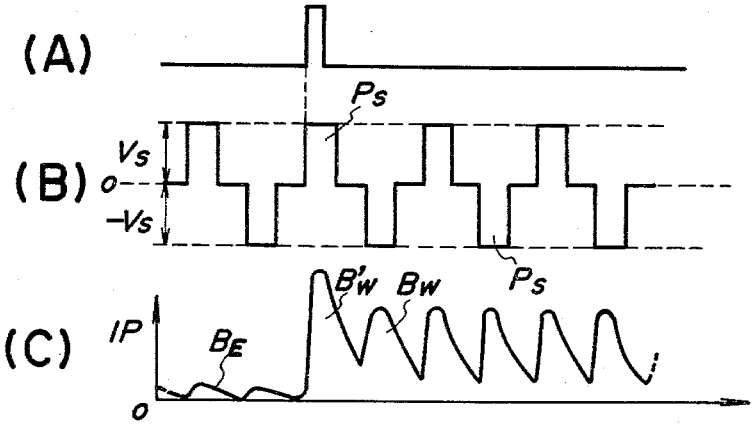
FIG. 7 is a time chart for explaining the operation of the drive system of FIG. 6.

FIG. 7 shows relationships among the application of the electron beam (A), the sustaining pulse signal (B), and the brightness (C) of light generated from the EL panel. The application of the electron beam is timed in agreement with the sustaining pulse $P_s$. More specifically, the one field scanning of the electron beam is conducted while the sustaining pulse $P_s$ bears the peak value. The application of the electron beam is timed in agreement with either one of the positive and negative peaks of the sustaining pulse signal.

Thereafter, the written information is maintained by the sustaining pulse signal. More specifically, the position to which the electron beam is applied exhibits the brightness $B_W$ (see FIG. 1) upon receiving the sustaining pulse signal, and the position to which the electron beam is not applied exhibits the brightness $B_E$ (see FIG. 1) upon receiving the sustaining pulse, thereby displaying the pattern corresponding to the pattern signal.

The clean display can be obtained, since the emission spectrum of the thin-film EL element is about 5800 Å whereas the light response spectrum of the thin-film EL element is about 3500 Å. The thus written information can be erased by applying the erase pulse voltage from the erase signal generator 21. The ZnS layer 4 is not uniform due to the fabrication step. More specifically, the ZnS grain close to the glass substrate 1 is small and the orientation thereof is not good. Contrarily, the ZnS grain close to the rear metal electrode 6 is large and the orientation thereof is good. Therefore, the boundary level is different from each other at the front and rear surfaces of the ZnS layer 4. In order to ensure stable operation, in accordance with the present invention, the electron beam is applied to the EL element through the rear metal electrode 6 while the rear metal electrode 6 is connected to receive the positive voltage and the transparent front electrode 2 is connected to receive the negative voltage.

Figure 8:
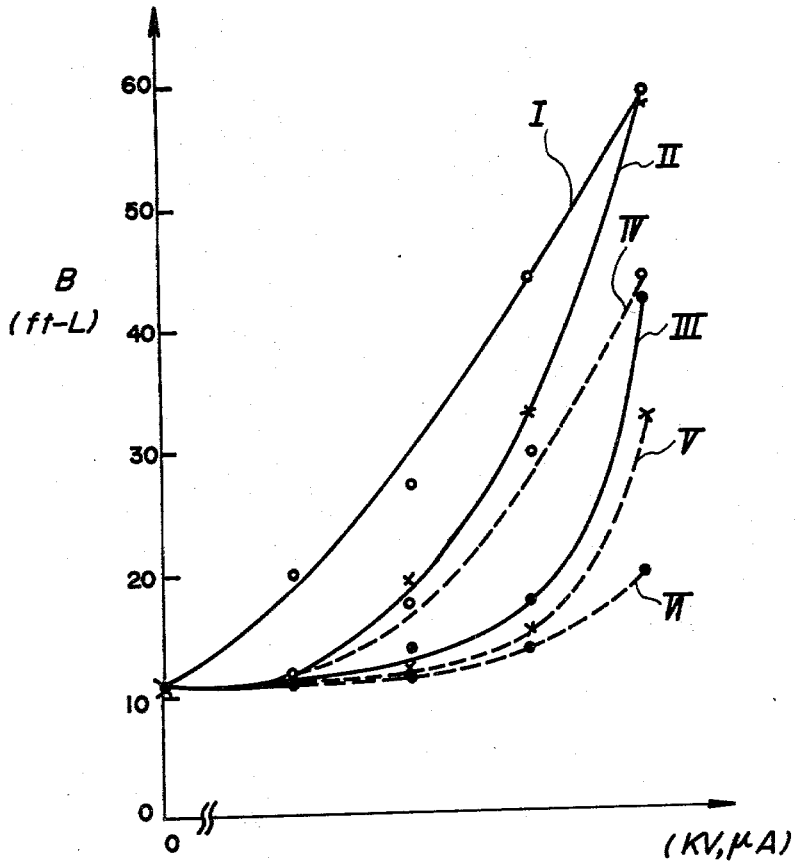
FIG. 8 is a graph showing electroluminescent brightness versus applied electron beam strength characteristics of the electroluminescent element of FIG. 3.

FIG. 8 shows electroluminescent brightness versus electron beam strength characteristics of the EL element of the above construction. In FIG. 8, the axis of ordinates indicates the electroluminescent intensity (ft—L) and the axis of abscissas indicates the intensity of the electron beam applied to the EL element. The sustaining pulse signal has the frequency of 1 KHz, the pulse width of 200 μsec, and the peak value of 230 V. The curve I represents the situation where the electron beam is applied for 250 μsec under the condition where the rear metal electrode 6 is connected to receive the positive voltage. The curve II represents the situation where the electron beam is applied for 160 μsec under the condition where the rear metal electrode 6 is connected to receive the positive voltage. The curve III represents the situation where the electron beam is applied for 100 μsec under the condition where the rear metal electrode 6 is connected to receive the positive voltage. The curve IV represents the situation where the electron beam is applied for 250 μsec under the condition where the transparent front electrode 2 is connected to receive the positive voltage. The curve V represents the situation where the electron beam is applied for 160 μsec under the condition where the transparent front electrode 2 is connected to receive the positive voltage, and the curve VI represents the situation where the electron beam is applied for 100 μsec under the condition where the transparent front electrode 2 is connected to receive the positive voltage.

Figure 9:
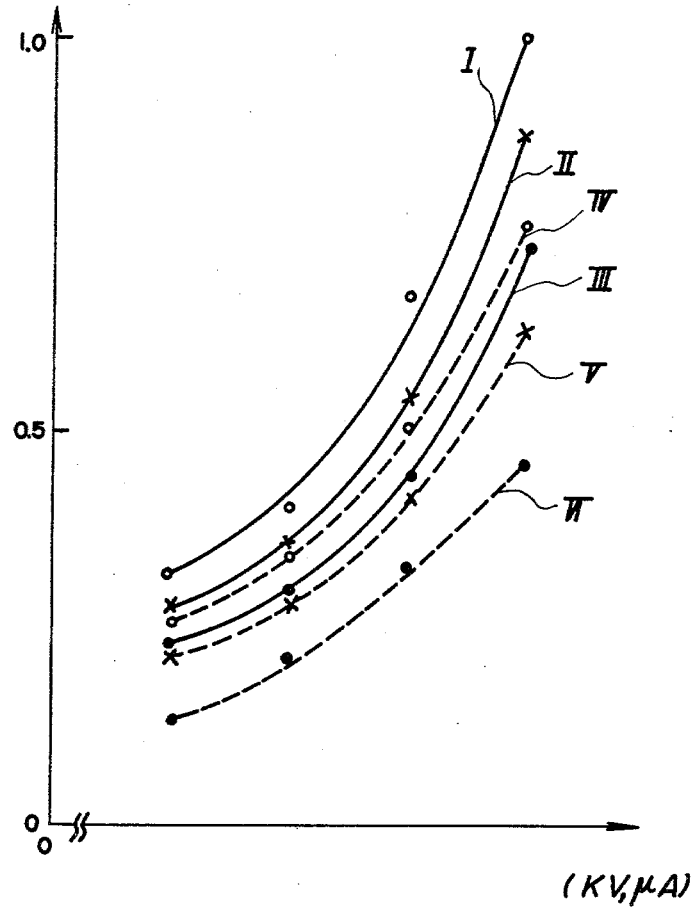
FIG. 9 is a graph showing polarization amount stored in a ZnS:Mn layer of the electroluminescent element of FIG. 3 versus applied electron beam strength characteristics.

FIG. 9 shows polarization voltage generated in the ZnS:Mn layer versus electron beam strength characteristics of the EL element of the above construction. In FIG. 9, the axis of ordinates indicates the polarization voltage generated in the ZnS:Mn layer, and the axis of abscissas indicates the intensity of the electron beam applied to the EL element. Curves I through VI represent the situations under the same conditions as that of the curves I through VI of FIG. 8.

In the foregoing embodiment, the EL element has the hysteresis characteristics. However, the present invention is applicable to the EL element which does not show the hysteresis phenomenon.

Figure 10:
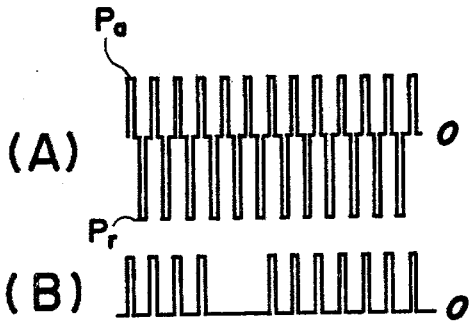
FIG. 10 is a time chart for explaining another embodiment of a drive system of the present invention.

FIG. 10 shows a voltage signal and an electron beam applied to the EL element which does not show the hysteresis phenomenon.

The thin-film EL element is connected to receive the voltage signal through the transparent front electrode 2 and the rear metal electrode 6, of which the waveform is shown in (A) of FIG. 10. The voltage signal comrises write-in bias voltage pulses $P_a$ and refresh pulses $P_r$. The electron beam is applied to the EL element through the rear metal electrode 6 while the write-in bias voltage pulse $P_a$ is applied to the rear metal electrode 6 as shown in (B) of FIG. 10.

The application of the write-in bias voltage pulse $P_a$ and the electron beam is controlled for every picture point. The write-in bias voltage pulse $P_a$ is selected at a desired value so that a picture point, where the electron beam and the write-in bias voltage pulse $P_a$ are simultaneously applied, exhibits the electroluminescence of high brightness, whereas a picture point to which only the write-in bias voltage pulse $P_a$ is applied does not exhibit the electroluminescence of high brightness. The refresh pulse $P_r$ is selected at a value below the threshold level of the electroluminescence of the thin-film EL element, and is selected at a value at which the electroluminescence is conducted when the refresh pulse is superimposed on the polarization voltage of the written picture point.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An electroluminescent display system for displaying video information in accordance with display information, comprising:

a. an electroluminescent display panel including
   an electroluminescent layer; a front electrode formed on one of the major surface of said electroluminescent layer; and
   a rear electrode formed on the other major surface of said electroluminescent layer; said front electrode comprising a transparent conductive film, said rear electrode comprising a metal film, the front transparent electrode and the metal rear electrode being uniformly formed on the entire surface of a display region of said electroluminescent layer;
   a first insulation thin film interposed between said electroluminescent layer and said front electrode;
   a second insulation thin film interposed between said electroluminescent layer and said rear electrode;

b. a voltage signal supply means for applying a voltage signal to said electroluminescent display panel through said front electrode and rear electrode;

c. an electron beam supply means for applying an electron beam to said electroluminescent display panel through said rear electrode; and d. a control means for controlling the application of said electron beam to said electroluminescent display panel in accordance with said display information.

2. The electrol uminescent display system of claim 1, wherein said electroluminescent layer comprises a thin-film ZnS layer doped with manganese;

said voltage signal applied to said electroluminescent display panel is below the threshold level of electroluminescence of said electroluminescent display panel;

said electron beam is applied to said electroluminescent display panel in synchronization with the application of said voltage signal to said electroluminescent display panel thereby superimposing the voltage level created by said electron beam onto the voltage level created by said voltage signal and thereby exceeding said threshold level of electroluminescence and causing the luminescence of said electroluminescent layer.

3. The electroluminescent display system of claim 1, wherein said electron beam supply means comprises an electron beam generator disposed at the back of said rear electrode, and said control means comprises a focus means and deflection means disposed between said electron beam generator and said rear electrode.

4. The electroluminescent display system of claim 1, wherein said electroluminescent display panel possesses hysteresis characteristics when plotted on a set of x-y coordinate axes having an abscissa represented by the brightness of said display panel and the ordinate represented by the voltage signal applied across said display signal, and said voltage signal comprises a sustaining pulse voltage said sustaining pulse voltage signal being chosen such that the difference between the brightness as measured on the brightness decreasing curve of said hysteresis loop characteristic and the brightness as measured on the brightness increasing curve of said hyesteresis loop characteristic is substantially a maximum.

5. The electroluminescent display system of claim 4, wherein said voltage signal further comprises an erase pulse voltage signal for erasing information written in said electroluminescent display panel.

6. A drive method for displaying a desired pattern on an electroluminescent display panel including an electroluminescent layer, a front electrode formed on one of the major surface of said electroluminescent layer, and a rear electrode formed on the other major surface of said electroluminescent layer said electroluminescent layer comprising a ZnS thin-film layer doped with manganese, said drive method comprising the steps of:

applying a voltage signal to said electroluminescent layer through said front and rear electrodes, the level of said voltage signal being lower than the threshold level of the electroluminescence of said electroluminescent layer; and applying an electron beam to a desired position of said electroluminescent layer through said rear electrode while said voltage signal is applied to said electroluminescent layer, the intensity of said electron beam being selected in such a manner that the electroluminescence is conducted when said electron beam is superimposed on said voltage signal.

7. The drive method of claim 6 wherein the grain of said ZnS is large at the surface of said electroluminescent layer nearest the rear electrode, the grain of said ZnS is small at the surface of said electroluminescent layer nearest the front electrode; and wherein said electron beam applied to said electroluminescent layer is directed toward said rear electrode, and the rear electrode is maintained positive with respect to said front electrode by said voltage signal.

8. The drive method of claim 7, wherein said electroluminescent display panel exhibits hysteresis characteristics, and said voltage signal comprises a sustaining pulse voltage signal.

* * * * *